US005894102A

United States Patent [19]

Oberlin et al.

[11] Patent Number: 5,894,102

[45] Date of Patent: Apr. 13, 1999

[54] SELF-CORRECTING INDUCTIVE FUZE SETTER

[75] Inventors: Richard P. Oberlin, Phoenix; Robert T. Soranno, Baldwin, both of Md.

[73] Assignee: AAI Corporation, Cockeysville, Md.

[21] Appl. No.: 09/001,693

[22] Filed: Dec. 31, 1997

[51] Int. Cl.[6] ..... F42C 17/04

[52] U.S. Cl. ..... 89/6.5; 102/206

[58] Field of Search ..... 89/6, 6.5; 102/206, 102/266

[56] References Cited

U.S. PATENT DOCUMENTS

| | | | |
|---|---|---|---|
| 1,917,814 | 7/1933 | Ruhlemann | 89/6.5 |
| 4,142,442 | 3/1979 | Tuten | 89/6.5 |
| 4,283,989 | 8/1981 | Toulios et al. | 89/6.5 |
| 4,649,796 | 3/1987 | Schmidt | 89/6.5 |
| 4,862,785 | 9/1989 | Ettel et al. | 89/6.5 |
| 5,343,795 | 9/1994 | Ziemba et al. | 89/6.5 |

FOREIGN PATENT DOCUMENTS

| | | | |
|---|---|---|---|
| 286270 | 7/1991 | Italy | 89/6 |

*Primary Examiner*—Stephen M. Johnson
*Attorney, Agent, or Firm*—Venable

[57] ABSTRACT

A self-correcting inductive fuze setter is used to detect and correct any errors that might occur during transmission and reception of a velocity corrected time data word so that a projectile will be detonated at the proper time. The self-correcting inductive fuze setter uses an error detection/correction algorithm to create an encoded data word from the velocity corrected time data word. Next, the encoded data word is used to digitally modulate a carrier signal, which is then transmitted from the muzzle of the weapon to the projectile. The received carrier signal is then demodulated by a demodulator/filter and decoded by a decoder located on the projectile producing the original velocity corrected time data word. In addition, the self-correcting inductive fuze setter will measure the error in both the high-speed fuze oscillator and the low-speed fuze oscillator located on the projectile and adjust the transmitted data word to account for these errors. Lastly, enhanced noise interference rejection is obtained by encasing the muzzle extension in a magnetic metal.

18 Claims, 5 Drawing Sheets

SELF-CORRECTING INDUCTIVE FUZE SETTER

CROSS REFERENCE TO RELATED APPLICATIONS

This application is related to the following applications: "One-Shot High-Output Piezoid Power Supply" Ser. No. 09/001,687 by Richard P. Oberlin and Robert T. Soranno; "Ultra Low-Power Fast Start Precision Oscillator" Ser. No. 09/001,690 by Richard P. Oberlin; "Muzzle Velocity Sensor" Ser. No. 09/001,694 by Richard P. Oberlin and Doug R. Cullison; "Accurate Ultra Low-Power Fuze Electronics" Ser. No. 09/002,247 by Richard P. Oberlin and Robert T. Soranno; and "Piezoid Electrical Gun Trigger" Ser. No. 09/001,688 by Richard P. Oberlin, each of which is filed concurrently herewith, commonly owned, and incorporated herein by reference.

BACKGROUND OF THE INVENTION

The present invention relates to a new and improved means and method for accurately transferring fuze timing data from a muzzle extension to a fast moving projectile which contains a programmable projectile fuze. The programmable projectile fuze comprises a fuze and a programmable counter, which is set to trigger the fuze, thereby exploding the projectile at the appropriate time. There is also provided an apparatus attached to the muzzle extension for measuring the muzzle velocity of the projectile in order to set or adjust the counter for triggering the fuze as a function of the muzzle velocity. A transmitter coil secured to the muzzle of the weapon inductively sets the counter.

In order to be able to set the programmable fuze with the requisite accuracy, 20 bits must be transmitted from the transmitter coil to the receiver coil. Assuming a projectile velocity of 900 fps or 0.0108 in/microseconds, there is a very short amount of time to transmit the muzzle velocity from the transmitter mounted in the muzzle of the weapon to the receiver on the projectile. Therefore, high frequencies are used to transmit the data.

In the prior art, two methods have generally been used to convey fuze set time. Previous inductive fuze transfer methods have used an analog voltage to convey fuze set time or a series of comma free base band pulses. Using an analog voltage has not been accurate enough or robust enough for most real applications. Similarly, transmitting comma free base band pulses requires a relatively large minimum inductance to insure that the data pulse is transferred. Furthermore, a substantial dead time between bits is needed to ensure that inductive storage from a previous bit dies down sufficiently before the next bit starts. Therefore, no previously known prior art involving inductive fuze transfer provides for carrier modulated pulses, error detection/correction and/or automatic projectile timing oscillator correction like the present invention does.

SUMMARY OF THE INVENTION

It is a primary object of this invention to produce a new and improved apparatus for transferring fuze timing data from a transmitting coil mounted on a muzzle through which a projectile was fired to a receiving coil located on the projectile.

Yet another object of the invention is to provide a means to automatically correct the transferred fuze timing data for timing oscillator error.

Yet still another significant object of the invention is to use carrier digital modulation in transferring fuze timing data. This allows the use of smaller inductance, faster operation, complete control of response time, inherent noise filtering, better match to driving electronics and a high signal to noise ratio.

A fourth object of the invention is to use self-synchronizing (comma free) coding when transferring faze timing data. This eliminates the need to recover or regenerate the transmitted carrier.

A fifth object of the invention is to use error detection of up to two errors and correction of one error to increase the robustness of the data transfer of the setting time to the fuze, thus providing both increased safety (eliminating premature detonation) and increased reliability (by correcting single errors that could have occurred in the transmitter, in the transmission path or in the receiver).

A sixth object of the invention is a new and improved apparatus for transferring faze timing data with increased noise and interference/countermeasures immunity.

The invention will be better understood and objects other than those set forth above will become apparent when consideration is given to the following detailed description thereof. Such description makes reference to the annexed drawings wherein throughout the various figures of the drawings, there have been generally used the same reference terminology to denote the same or analogous components and specifically wherein:

DETAILED DESCRIPTION OF THE PREFERRED EMBODIMENTS

The Fire Control System (FCS) in a weapon is alerted when a projectile passes through velocity sensors located in the weapon's muzzle extension. First, the FCS calculates the projectile muzzle velocity. Then, the FCS uses this calculated velocity to correct a data word representing computed air burst, that is, the time until the projectile reaches the desired detonation position relative to the target. Next, the FCS sends the velocity corrected data word (which represents the calculated time until impact) to a self-correcting inductive fuze setter. The fuze setter uses this word to determine when to detonate a delayed action fuze inside the projectile. It is important to detect and correct any errors that might occur during transmission and reception of the velocity corrected data word so that the projectile will be detonated at the proper time. The self-correcting inductive faze setter performs this error detection/correction of the velocity corrected data word.

Figure 1:
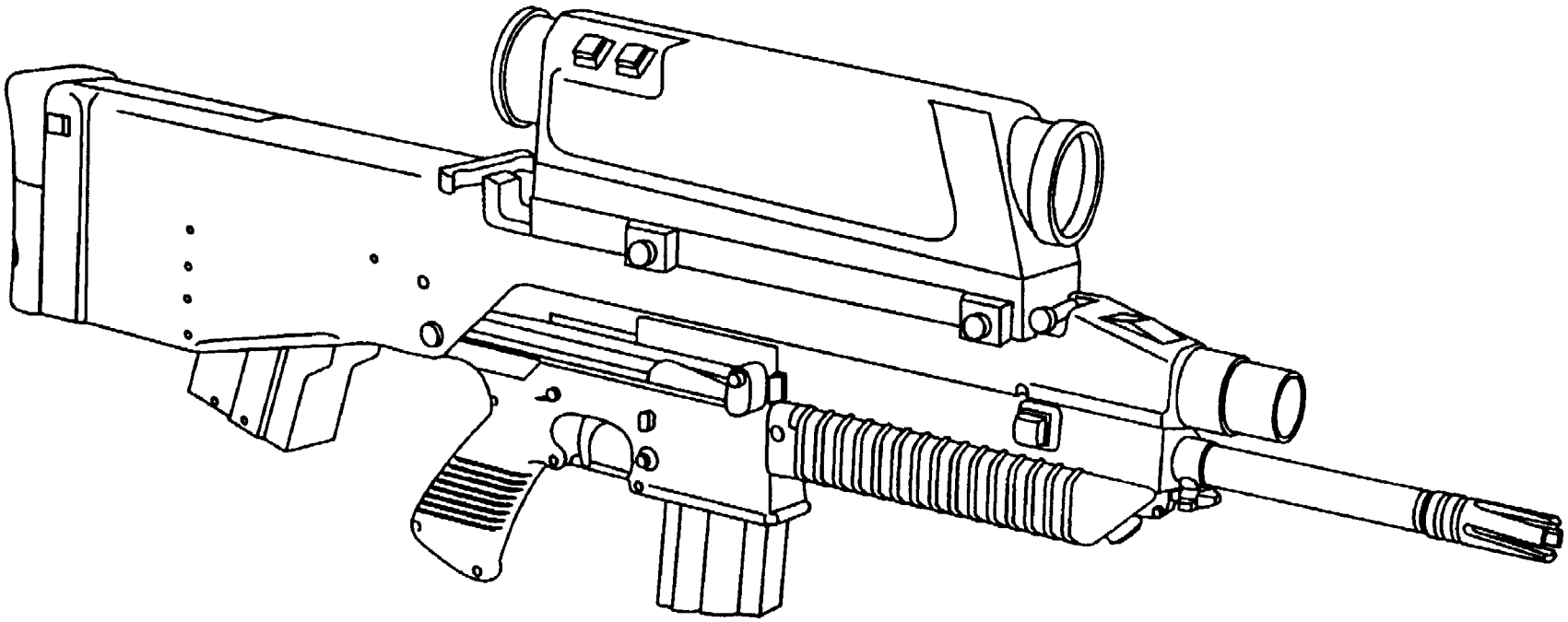
FIG. 1 is a top, right-side perspective view of a combination weapon which incorporates the self-correcting inductive fuze setter according to the present invention.
Figure 2:
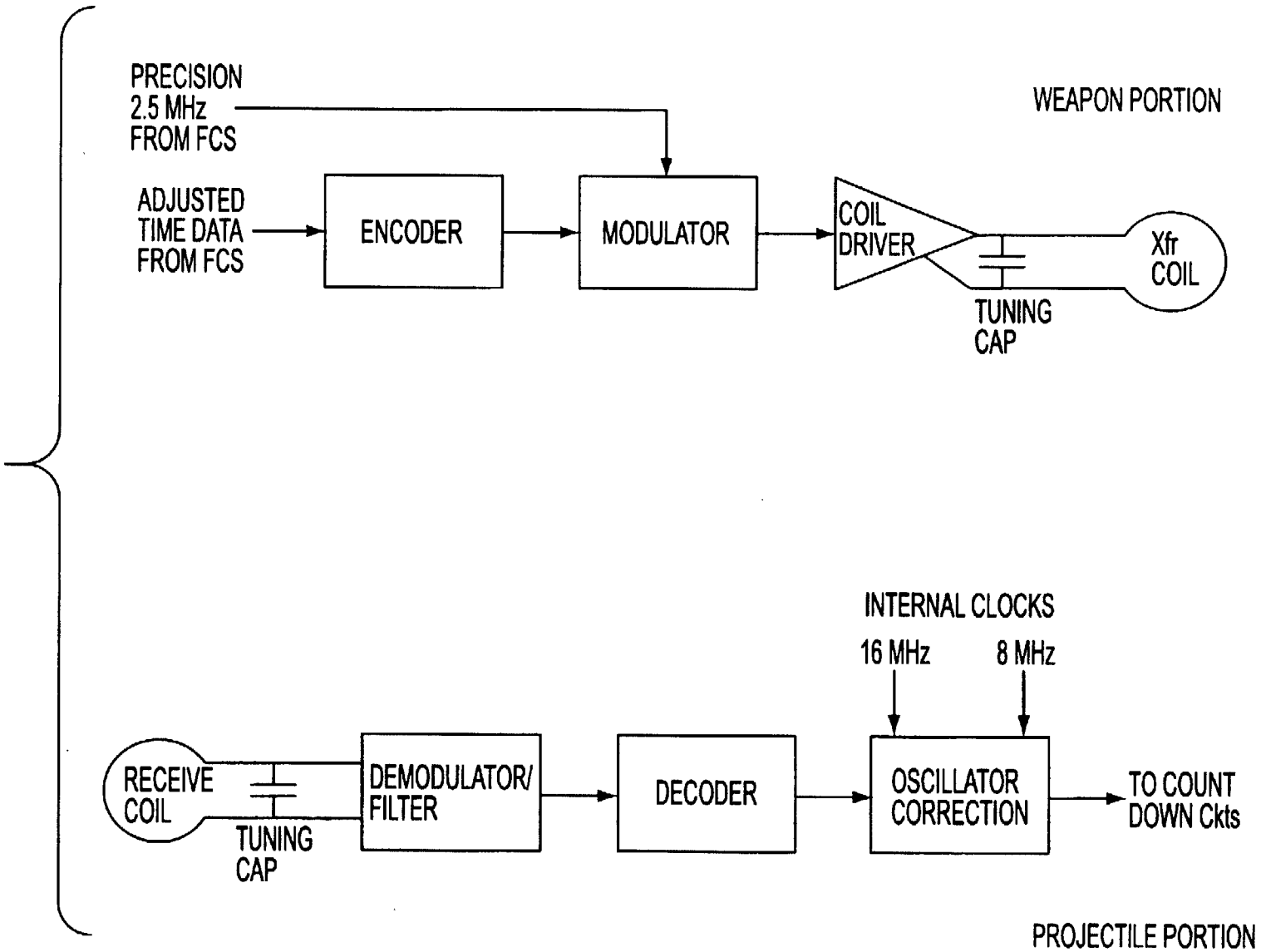
FIG. 2 is a schematic circuit diagram showing the components, which comprise the self-correcting inductive fuze setter.

The self-correcting inductive fuze setter is located partly in the weapon and partly in the projectile fuze electronics as indicated in FIG. 2. The transmitter portion (located in the weapon) consists of an encoder, a modulator, a coil driver and a data transfer coil. The receiver portion (located in the projectile) consists of a tuned receiving coil, demodulator/filter, and a microcontroller, which, in software, performs the decoding, and timer oscillator correction functions.

The self-correcting inductive fuze setter detects and corrects error of the velocity corrected data word in the following manner. Initially, the fire control setter transmits the velocity corrected time data word to the encoder. The encoder applies an error detection/correction algorithm to the 14-bit word. In a preferred embodiment, the encoder uses two error detection/correction schemes. First it performs a parity check by adding an even parity bit to the 14-bit data word, making it 15 bits long. Therefore, the total number of "1's" in the now 15-bit data word must be an even number. For example, if the 14 bit data word has an odd number of "1's", then the parity bit is set to "1." On the other hand, if the 14 bit data word has an even number of "1's", the parity bit is set to "0."

Next, in addition to using a parity check bit, the encoder uses a forward error-correcting code to detect and correct errors. In a preferred embodiment, a 32 bit Hamming error detection/correction code is used. If m represents the number of bits in a data string and n represents the number of bits in the Hamming code, n must be the smallest number such that:

$$2^n \geqq m+n+1$$

Since $32=2^5$, five extra bits are added to the data word to accomplish the error detection/correction. As a result, the data word is now 20 bits long (1 extra bit for the parity check and 5 extra bits to produce the Hamming Code).

To generate a comma free code (one that is self synchronizing and that does not require carrier recovery in the projectile for demodulation), each bit is then converted to a three sub-bit sequence. For example, a "0" becomes a "100", and a "1" becomes a "110." Thus a 20 bit data word becomes a sequence of 60 sub bits where sub bits 1, 4, . . . (3(n−1)+1) are always "1's," sub bits 3, 6, . . . (3n) are always "0's, " and sub bits 2, 5,. . . (3n−1) are the 20 data bits. Lastly, a "11" end bit is appended to the end of each 20 bit sequence. Therefore, the 20-bit data word becomes a sequence of 62 sub bits. A "0" level is generated at all times when no data word is present.

Next, this 62-sub bit word is then transmitted to the modulator as shown in FIG. 2. The modulator uses the 62 sub bit word to amplitude modulate a carrier frequency. Amplitude modulation of a carrier frequency synchronized to the data bit stream is utilized to simplify demodulation in the projectile and to generate a precisely repeating waveform so that there is minimum time jitter on the data pulses after the signal is demodulated.

Figure 3:
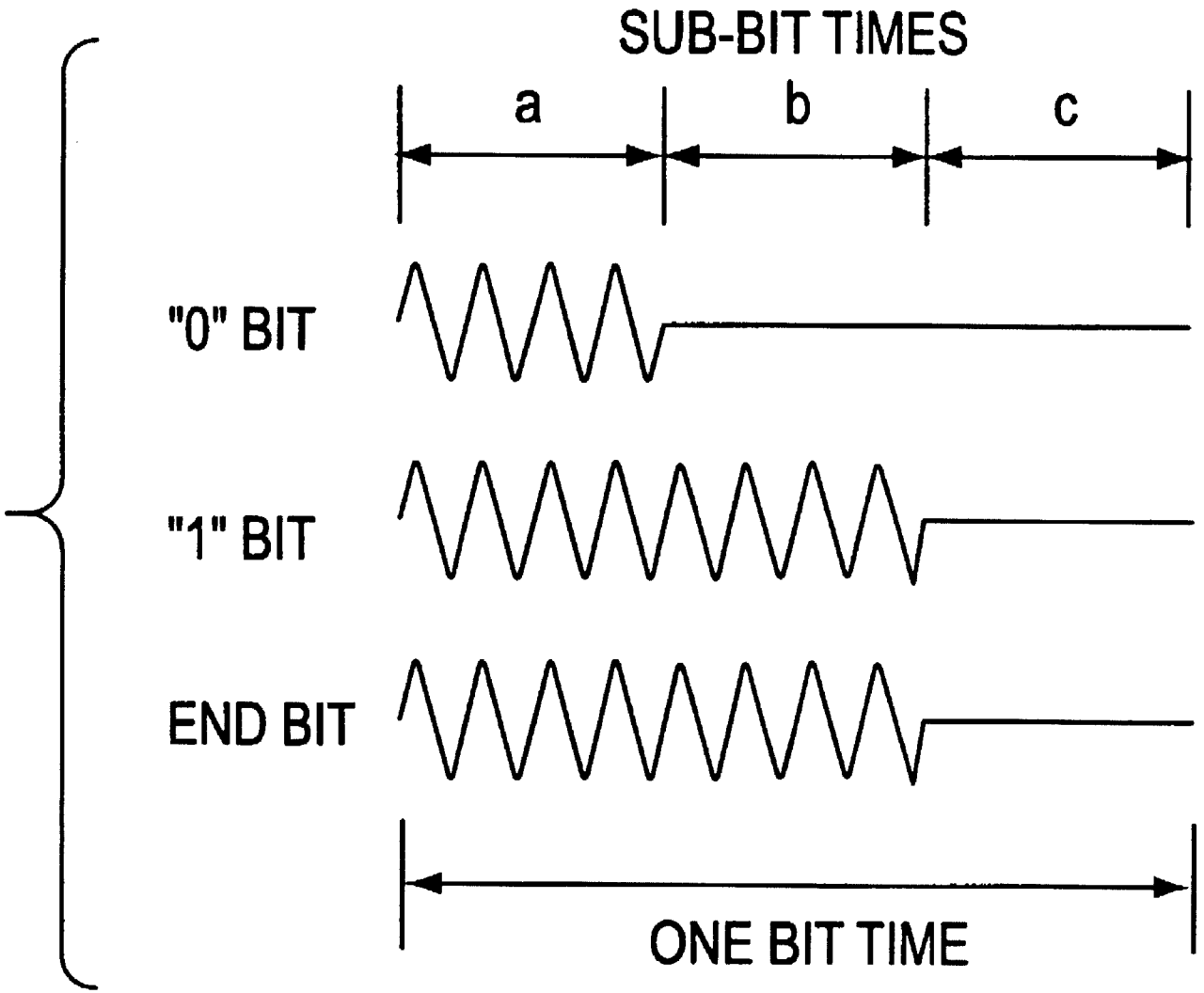
FIG. 3 illustrates modulated bit times for the modulated data signal.

In a preferred embodiment, the carrier frequency was chosen to be 2.5 MHz, with exactly 4 carrier cycles used for each sub-bit, or 12 cycles per data bit. Thus one data bit is 4.8 microseconds long, giving a bit rate of about 208 KBPS. The entire data word is 99.2 microseconds long. The resulting modulated output is shown in FIG. 3 for different bit types.

The modulated signal is then input to a coil driver circuit. The coil driver circuit amplifies the modulated signal and then inputs it to the data transfer coil. The signal is amplified sufficiently so that no amplification is required in the projectile, thereby minimizing projectile cost. In a preferred embodiment, the coil driver circuit consists of a MOS switch driver in series with an output tuning capacitor (which matches the coil to the driver). The capacitor coil tuned circuit "Q" is relatively low (due to the low driver impedance) and, therefore, does not significantly affect the response time.

Figure 4:
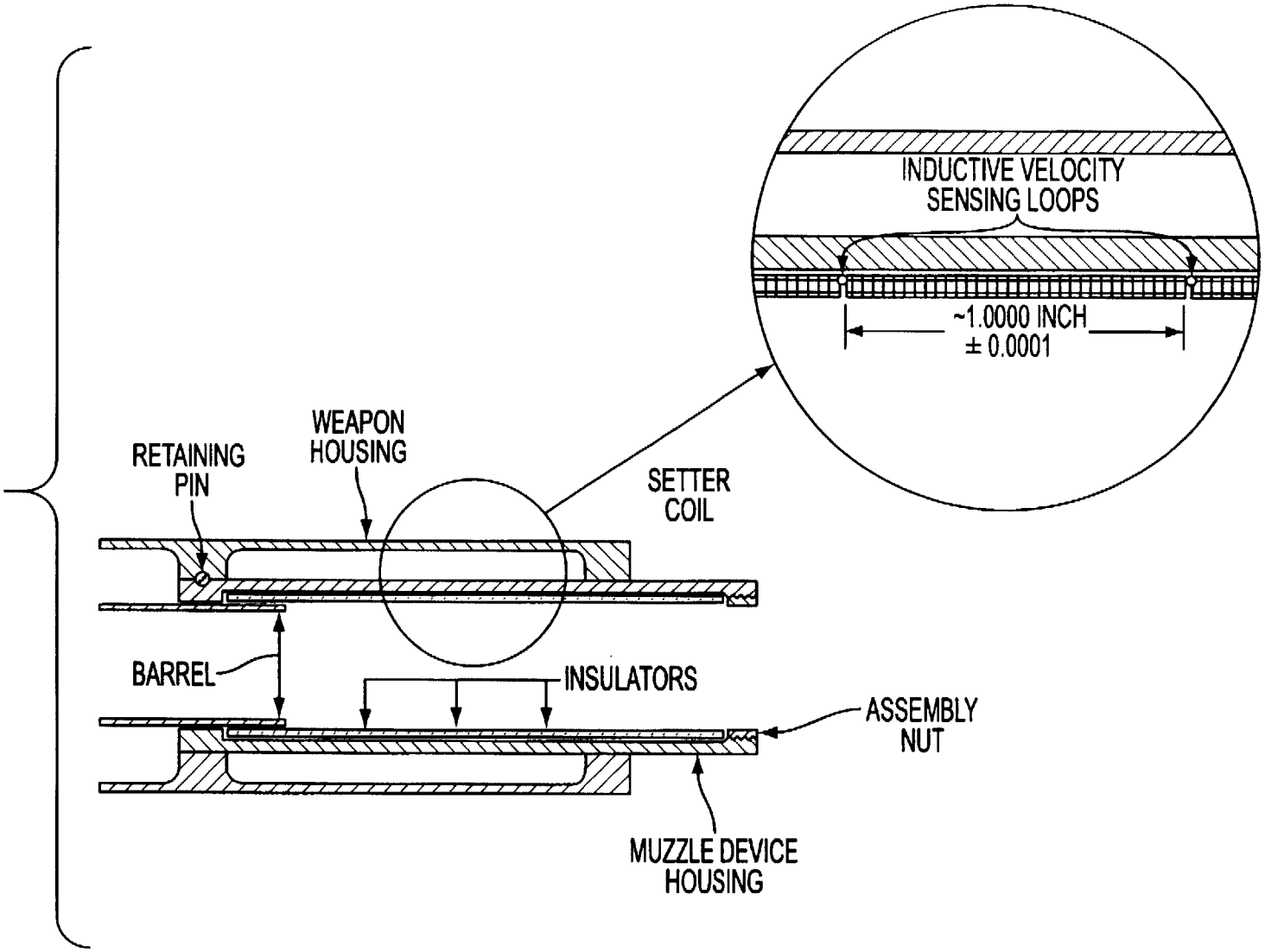
FIG. 4 is a drawing of the faze setter transfer coil positioned inside the weapon's muzzle attachment.

Next, the amplified modulated signal is input to the data transfer coil as indicated in FIG. 2, which transmits the amplified modulated signal to the receiving coil located on the projectile's outer body. The transfer coil is located in the muzzle extension of the weapon. Since the projectile moves at a speed of 900 fps or 0.0108 in/microseconds and since the data word is almost 100 microseconds long (the actual length is 99.2 microseconds long), a minimum transfer distance of 1.08 inches is required. In a preferred embodiment, the transfer coil consists of 7 turns across a distance of 1.50 inches. The location of the coil at the end of the muzzle is shown in FIG. 4.

The data is transferred across an air gap to a receiving coil in parallel with a tuning capacitor, both of which are located on the projectile's outer body. The "Q" of the receiving coil circuit normally can be quite high. Therefore in a preferred embodiment, a resistor is placed in parallel with the capacitor to reduce the "Q." The resistor value is chosen to obtain as narrow a bandwidth as possible (to improve transfer efficiency and noise immunity), while at the same time maintaining an acceptable rise time. (Bandwidth and rise time are inversely related. The wider the bandwidth, the shorter the rise time and vice versa). In a preferred embodiment, the receiving coil consists of 6 to 9 turns across a 0.1" distance and the value of the capacitor is 3000 pF.

The received signal is then transmitted to a demodulator/filter as indicated in FIG. 2. The demodulator/filter comprises a full wave Schottky bridge rectifier in series with an RLC filter. The demodulator removes the carrier frequency from the amplitude-modulated signal. Full wave rectification allows for a rapid rise time and efficient use of the received signal energy.

Figure 5:
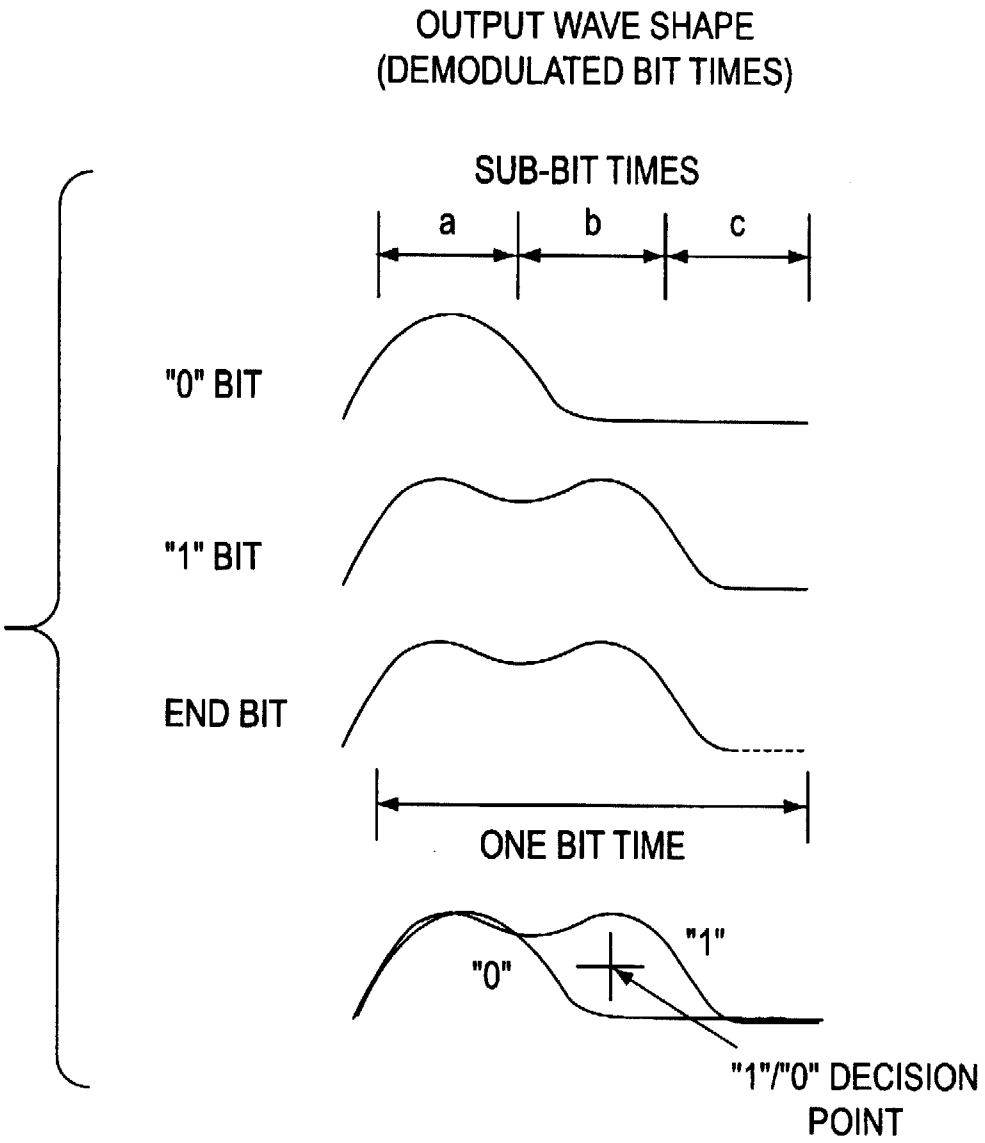
FIG. 5 illustrates demodulated bit times for the demodulated data signal.

Because the modulated signal is detected by use of a nonlinear device, undesired frequency components are generated which must be filtered out. The RLC filter is used to attenuate these undesired frequencies without unduly slowing the pulse rise time. The resulting signal is at a high useable level without any need of further amplification. The output waveforms are shown in FIG. 5.

The signal is next transmitted to the decoder as shown in FIG. 2. The decoder does the inverse of the encoder. In a preferred embodiment, the decoder checks the received data word in two stages. First, the Hamming code is checked and second, the data word's overall parity is checked (but only if an error is found using the Hamming Code). The decoder takes the signal from the demodulator/filter and stores it in a 20 bit register (the end bit is discarded in the process). It then uses the last five bits to test the first 15 bits in accordance with the Hamming code. If no error is found, the decoder outputs the 15 bits as received, bypassing the overall parity check.

On the other hand, if one error is found, the decoder corrects it and then performs an overall parity check using the 15th bit for comparison. The system uses a parity check to check for a second error because the Hamming code is not able to detect multiple errors in a single block. If a second error is then found, the decoder outputs 14 bits that represent the maximum time for that faze type, and not the data word it received.

Given the high signal to noise ratio under which data transfer takes place, it is unlikely that any bit error will occur. However, use of an error detection/correction apparatus such as the one recited, provides extra insurance from both a safety and a fuze reliability standpoint. Furthermore, the method works on any error that occurs in the system between the output of the encoder and the input to the decoder.

Next, the received data stream is transmitted to a timing oscillator correction circuit as indicated in FIG. 2. The timing oscillator correction circuit uses the received data stream to check oscillator accuracy of both the high-speed and the low-speed fuze oscillators. First, the accuracy of the high-speed fuze oscillator is checked. Once the projectile is fired, the set back force causes the fuze power supply to come up to voltage and the fuze circuitry wakes up. A short time after the fuze circuitry wakes up (in a preferred embodiment this time equals a few milliseconds), the first sub bit "1" from the received data stream is received (or the "start" bit if one is used) which starts a counter contained within the oscillator correction circuit. The counter counts the number of high-speed fuze cycles input to the counter until it receives the first subbit "1" of the "end" bit, thereby stopping the counter. Thus, the counter counts the number of high-speed fuze cycles required to detect an entire message.

In a preferred embodiment, an entire message is contained in 20 bits. Therefore, the counter counts the number of high-speed fuze cycles contained within 20 bits and the output count of the counter represents the time between the 1st and the 21st bits. In a preferred embodiment, the high-speed fuze oscillator is set to 16 MHz. Therefore, the output count should be 16 MHz * 96 microseconds=1536, where 96 microseconds=20 * 4.8 microseconds and 4.8 microseconds represents the length of one data bit.

The oscillator correction is determined from the ratio of the measured count to 1536 counts. Once the correction is known (and stored), the correction factor is used to adjust the transmitted data word to account for error in the high-speed fuze oscillator. Next, the high-speed fuze oscillator is used to check the frequency of the low-speed count down fuze oscillator. In a preferred embodiment, the low-speed count down fuze clock runs at a nominal 8 kHz. The received decoded signal is then adjusted to account for the error in the low-speed count down fuze oscillator. The high-speed fuze clock is necessary to accomplish data transfer and clock correction because of the short times involved, the low-speed clock is used for count down to conserve power because of the long times involved.

Lastly, the adjusted decoded signal is output to count down circuits contained within the projectile. This signal is used to determine when to explode the projectile.

The net result of this two-clock based data transfer system is that precise time out accuracy is achieved without the need for precision components and/or precise oscillator calibration on the fuze. Because many more fuzes are manufactured than Fire Control Systems, and the fuze environment is much more severe for vibration and shock than the Fire Control System environment, it is much less costly to use a high precision oscillator in the fire control located in the muzzle of the weapon, than in the fuze. This reduces the cost of components and processes associated with fuze manufacturing and enhances the yield. Clock setting, temperature and aging problems then disappear. For example, temperature variation during a long, say 10-second time out, is not a problem due to the fact that thermal calculations show that only a small, 3° typical, temperature change would be caused by inflight heating.

Enhanced noise interference rejection is obtained by encasing the muzzle extension in a magnetic metal (iron, steel, or nickel). The muzzle extension (being several bore lengths long) acts as a circular waveguide. Electromagnetic energy cannot propagate into it unless that energy has a wavelength below the cutoff wavelength, which is about 1 GHz for an oversize 20 mm bore. Therefore, the magnetic metal extension electrostatically and magnetically attenuates any external signal.

While there are shown and described present preferred embodiments of the invention, it is distinctly understood that the invention is not limited thereto, but may be otherwise variously embodied and practiced within the scope of the following claims.

What we claim as our invention is:

1. Apparatus for accurately transferring fuze timing data from the muzzle of a weapon to a fuze of a projectile moving through said muzzle, comprising:

a transmitter portion located in the muzzle of said weapon and a receiver portion located in the projectile;

said transmitter portion comprising an encoder having an input and an output which receives a velocity corrected time data word on its input and then uses an error detection and correction algorithm to create an encoded data word from said velocity corrected time data word;

a modulator having a first input and a second input and one output, said first input is connected and electrically coupled to the output of said encoder and said second input is connected and electrically coupled to a carrier signal, said one output is a modulated signal comprising said carrier signal modulated by said encoded data word output from said encoder;

a coil driver circuit having an input and an output, said input is connected and electrically coupled to said output of said modulator, whereby said modulated signal output by said modulator is amplified by said coil driver;

a data transfer coil which is connected and electrically coupled to said coil driver circuit to transmit said modulated signal across an air gap;

said receiver portion comprising a receiving coil to receive said transmitted modulated signal, said receiving coil is connected in parallel and electrically coupled to a first capacitor;

a demodulator and filter which is connected and electrically coupled to said receiving coil, whereby said transmitted, modulated signal is demodulated and filtered producing said encoded data word;

a decoder which is connected and electrically coupled to said demodulator and filter, whereby said decoder decodes said encoded data word and detects and corrects any errors in said encoded data word; and an oscillator correction circuit having a first input, a second input and a third input and one output;

wherein said first input is connected and electrically coupled to a high-speed fuze oscillator;

said second input is connected and electrically coupled to said decoder so that said decoded data word can be used to turn said oscillator correction circuit on and off, whereby said oscillator correction circuit can count the number of high-speed fuze cycles contained in said decoded data word and then calculate and store a correction factor to adjust the decoded data word to account for error in said high-speed fuze oscillator; and said third input is connected and electrically coupled to a low-speed fuze oscillator, whereby once said correction factor is known, said high-speed fuze oscillator can be used to check the frequency of said low-speed fuze oscillator and adjust the decoded data word to account for error in the low-speed fuze oscillator.

2. The apparatus according to claim 1, wherein said error/correction algorithm further comprises a parity check, a forward error-correcting code, and converting each bit of said velocity corrected time data word to a three sub-bit sequence.

3. The apparatus according to claim 2, wherein said forward error-correcting code is a Hamming error detection and correction code.

4. The apparatus according to claim 2, wherein said forward error-correcting code is a 32 bit Hamming error detection and correction code.

5. The apparatus according to claim 4, wherein said carrier frequency signal is amplitude modulated by said encoded data word.

6. The apparatus according to claim 5, wherein said carrier frequency is 2.5 MHz.

7. The apparatus according to claim 1, wherein said coil driver circuit further comprises a MOS switch driver in series with and electrically coupled to a second capacitor.

8. The apparatus according to claim 7, wherein said data transfer coil consists of 7 turns across a distance of 1.50 inches.

9. The apparatus according to claim 1, wherein said data transfer coil consists of 7 turns across a distance of 1.50 inches.

10. The apparatus according to claim 1, wherein a resistor is placed in parallel with said first capacitor.

11. The apparatus according to claim 10, wherein said receiving coil consists of 6 to 9 turns across a 0.1" distance.

12. The apparatus according to claim 1, wherein said receiving coil consists of 6 to 9 turns across a 0.1" distance.

13. The apparatus according to claim 12, wherein the value of said first capacitor is 3000 pF.

14. The apparatus according to claim 1, wherein said demodulator and filter comprises a full wave bridge rectifier in series with and electrically coupled to an RLC filter.

15. The apparatus according to claim 1, wherein said muzzle is encased in a magnetic metal so that the muzzle acts as a waveguide and filters out high frequency noise.

16. The apparatus according to claim 15, wherein said magnetic metal is iron.

17. The apparatus according to claim 15, wherein said magnetic metal is steel.

18. The apparatus according to claim 15, wherein said magnetic metal is nickel.

* * * * *